US005106081A

United States Patent [19]

Webb

[11] Patent Number: 5,106,081

[45] Date of Patent: Apr. 21, 1992

[54] LEG EXERCISE MACHINE

[75] Inventor: Gregory M. Webb, Independence, Va.

[73] Assignee: Nautilus Acquisition Corporation, Independence, Va.

[21] Appl. No.: 646,805

[22] Filed: Jan. 28, 1991

[51] Int. Cl.[5] ..... A63B 23/04

[52] U.S. Cl. ..... 482/137; 482/100

[58] Field of Search ..... 272/96, 117, 118, 123, 272/130, 134, 136, 142

[56] References Cited

U.S. PATENT DOCUMENTS

| | | | |
|---|---|---|---|
| 4,254,949 | 3/1981 | Brentham | 272/134 X |
| 4,500,089 | 2/1985 | Jones | 272/117 |
| 4,502,681 | 3/1985 | Blomqvist | 272/117 X |
| 4,511,137 | 4/1985 | Jones | 272/134 X |
| 4,838,548 | 6/1989 | Maag | 272/134 |
| 4,872,670 | 10/1989 | Nichols | 272/134 |
| 4,883,270 | 11/1989 | Maag | 272/134 |

FOREIGN PATENT DOCUMENTS

| | | | |
|---|---|---|---|
| 177017 | 4/1986 | European Pat. Off. | 272/134 |

*Primary Examiner*—Robert Bahr

*Attorney, Agent, or Firm*—Bell, Seltzer, Park & Gibson

[57] ABSTRACT

A leg exercise machine includes a frame having a seat connected thereto for supporting a user in a seated position thereon. A foot engaging member is adapted for engaging the feet of a user and receiving force from the user leg. The foot engaging member is pivotally mounted on the frame by a four-bar linkage which includes first and second lever arms pivotably mounted on the frame. The pivotal mounting of the lever arms provides for back and forth movement along a path of travel and about an instantaneous (changing) axis of rotation for changing the angle of inclination of the foot engaging member so that a force substantially normal to the foot engaging member is directed substantially up the leg and tibia during corresponding movement of the user. The second lever arm is operatively connected to a weight stack for transmitting the pivotal back and forth movement of the leg engaging member to movement of the weight stack to thereby exercise the legs of a user.

16 Claims, 3 Drawing Sheets

LEG EXERCISE MACHINE

FIELD OF THE INVENTION

This invention relates to a leg exercise machine, and more particularly, to a leg exercise machine having a foot engaging member, in the form of a footboard, movable along an eccentric path of travel about an instantaneous (changing) axis of rotation so that the angle of inclination of the foot engaging member is constantly changed wherein forces are directed only up the lower leg and tibia of a user during corresponding movement of the footboard by the user.

BACKGROUND OF THE INVENTION

On most prior art exercise machines, when exercising the leg muscles, the user engages a foot engaging member, typically in the form of a plate or footboard on which the user rests his feet, and exerts back and forth movement thereagainst for exercising the legs. The foot engaging member is operatively connected to a resistance in the form of a stack of metal plates for providing resistance against movement of the foot engaging member during exercise movement Typically, during movement, as the leg extends and pushes the foot engaging member along its eccentric path of travel, the angle of inclination of the lower leg and tibia constantly changes.

Heretofore, most prior art machines for exercising the leg have been constructed to include a foot engaging member which is movable in a back and forth somewhat arcuate or eccentric path of travel where the rate of angle change of the foot engaging member during pivotal movement is substantially constant so that the imposed forces are not properly directed up the lower leg and tibia. For example, in commonly assigned U.S. Pat. No. 4,511,137 to Jones, the foot engaging member is attached to the lower portion of a lever arm. The lever arm is pivotally mounted in a medial location thereon between two frame members. During back and forth exercise movement, the lever and foot engaging member attached thereto rotate about a fixed axis of rotation. The maximum exercise efficiency is not obtained because during extension and retraction of the lower leg during exercise, the forces normal to the footboard and exerted against the leg are not always exerted up the lower leg and tibia. The semi-circular movement of the foot engaging member does not compensate for the constantly changing angle in movement of the lower leg and tibia during exercise.

SUMMARY OF THE INVENTION

Therefore, it is an object of the present invention to provide a leg exercise machine which overcomes the deficiencies of the prior art.

Another object of the present invention is to provide a leg exercise machine which includes a foot engaging member adapted for engaging the feet of a seated user and receiving force from the legs for exercising the legs, and wherein the foot engaging member is movable along a back and forth path of travel so that an instantaneous (changing) axis of rotation is generated for changing the angle of inclination of the foot engaging member so that a force substantially normal to the foot engaging member is directed substantially along the lower leg and tibia during corresponding movement of the legs of the seated user.

The leg exercise machine in accordance with the present invention includes a frame and a seat connected to the frame for supporting a user in a seated position thereon. The seat is slidably mounted on the frame for varying the distance of the seat from the foot engaging member for varying the range of starting positions of a user seated on the frame.

First and second substantially vertically extending lever arms are pivotally mounted at their lower ends on the frame in spaced relation to each other. A support shaft is transversely mounted on the upper end of each lever arm. Each shaft is approximately equal in length and has aligned opposing ends. A pair of spaced, substantially parallel support arms are pivotally mounted on the support shafts and are mounted so that the distance between the lower lever arm ends is greater than the distance between the upper lever arm ends so that when the lever arms are pivotally moved in a back and forth movement, the motion of the lever arms defines an instantaneous (changing) axis of rotation.

A foot engaging member, in the form of a footboard, on which the user rests his feet is fixed to the parallel support arms for engaging the feet of a user and receiving force from the legs of the user to pivot the first and second lever arms so as to move the footboard in a back and forth movement along a predetermined path of travel about an instantaneous (changing) axis of rotation. This movement changes the angle of inclination of the footboard so that a force substantially normal to the footboard is directed substantially along the leg and tibia during corresponding movement of the user. A shaft is rotatably mounted on the frame and a variable radius cam is fixedly mounted on the shaft for rotatable movement therewith. A chain is entrained about the variable radius cam and has one end is fixed to the cam and the other end is attached to the second lever arm. A sprocket is fixed to the shaft and rotatable therewith and includes a chain interconnecting the sprocket and resistance means in the form of a stack of weights. During back and forth movement of the footboard, the force exerted by a user's legs is transmitted to the stack of weights thereby lifting and lowering the stack of weights and exercising the legs of the user.

BRIEF DESCRIPTION OF THE DRAWINGS

Some of the objects and advantages of the present invention having been stated, others will be more fully understood from the detailed description which follows and by reference to the accompanying drawings in which.

DETAILED DESCRIPTION OF THE PREFERRED EMBODIMENTS

Figures 4, 5:
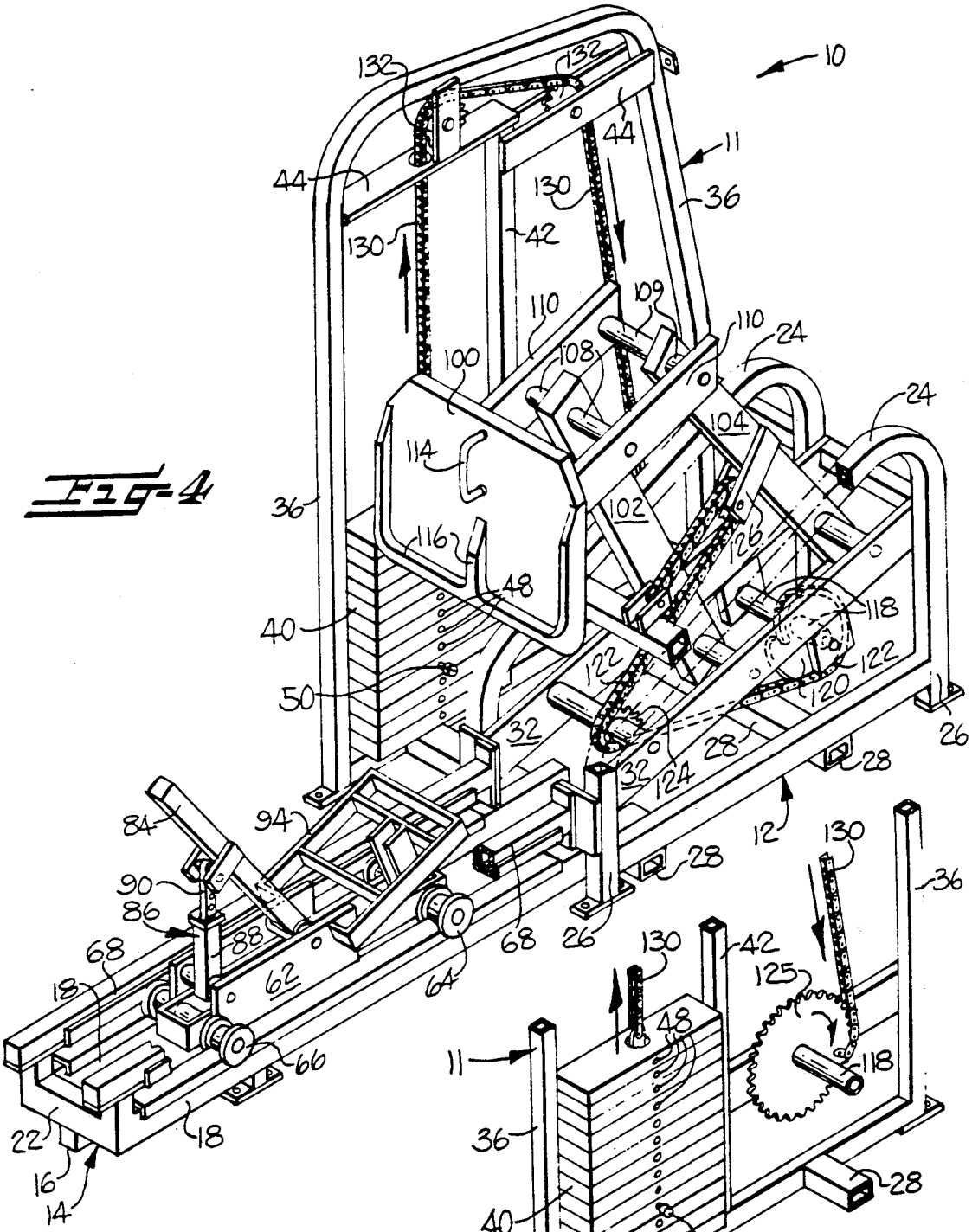
FIG. 4 is an isometric view of the leg exercise machine having the covers and padded portions removed from the frame and showing component parts of the machine.
FIG. 5 is a fragmentary isometric view of the weight stack, sprocket and a portion of the chain interconnecting the weight stack and sprocket.

Referring now to the drawings, there is illustrated a preferred embodiment of the leg exercise machine, broadly indicated at 10. As best shown in FIG. 4, the leg exercise machine includes a frame, broadly indicated at 11, and having respective front and rear frame portions, broadly indicated at 12 and 14. The frame 11 includes a lower horizontal base frame 16 with two substantially parallel, horizontally extending side frame rails 18 fixed in position to each other by reinforcing cross bars 22. Two inverted and parallel, upstanding, substantially U-shaped support braces 24 are fixed on the forward end of the side frame rails 18. The inverted, U-shaped support braces 24 incline downward toward the rear portion 14 of the machine and form legs 26 for supporting the front portion of the side frame rails 18 on a flat surface such as an exercise floor. Longitudinal transversely extending reinforcing braces 28 are fixed to the inverted U-shaped support braces 24 and provide rigidity thereto. Two substantially parallel and opposing lever arm mount braces 32 are affixed to the respective inverted, U-shaped support braces 24 and extend downward in a rearward direction.

Figure 1:
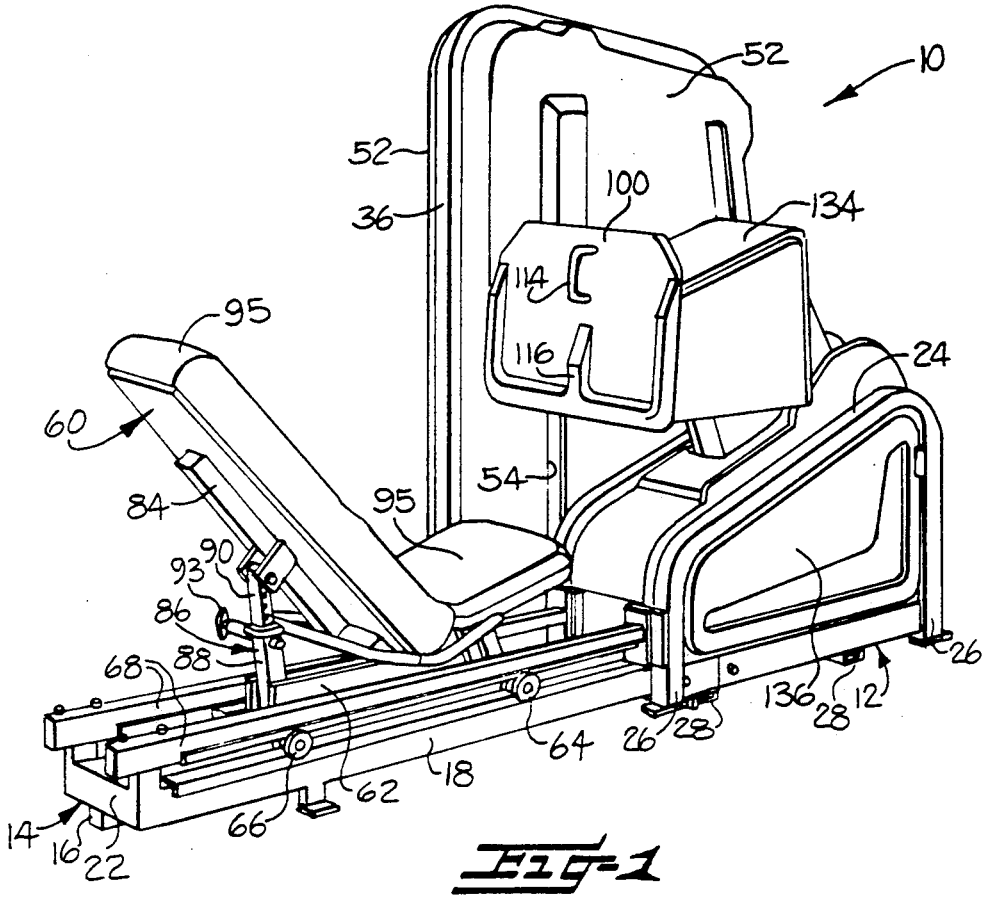
FIG. 1 is a perspective view of the leg exercise machine in accordance with the preferred embodiment of the invention.

A larger, inverted, U-shaped weight support frame member 36 is fixed to the lower portion of the transversely extending braces 28 and extends upward adjacent the front portion 12 of the leg exercise machine 10. Resistance means is supported for vertical movement on the frame member 36 and includes a plurality of weight plates forming a weight stack 40 which is supported for sliding movement between the rear leg of the weight support frame member 36 and a vertically extending leg member 42 which is fixed at its upper end to the weight support frame member 36 by a transverse cross bar 44 fixed to the weight support frame member 36. The weight plates 40 are supported for vertical sliding movement between the leg of the weight support frame member 36 and the vertically extending leg member 42 (FIG. 5). Additionally, spaced guide rods (now shown) can be included for aiding sliding movement and preventing the weight stacks from falling. A vertical selector guide and weight lifting rod 46 extends through the center portion of the weight stack 40. The individual weight plates 40 in the weight stack are provided each with horizontal openings 48 for reception of a selector pin 50 so that varying amounts of weight can be selected by the user to be lifted and lowered when exercising with the machine. As shown in FIG. 1, a two-piece molded cover 52 is mounted on opposite sides of the inverted U-shaped weight support frame member 36 and includes a slot opening 54 for gaining access to the selector pin 50 and choosing a desired weight.

A seat, illustrated broadly at 60 (FIGS. 1 and 4), is supported for longitudinal adjustable movement along the rear portion 14 of the frame 11. The seat 60 includes a guide roller support member 62 having front guide rollers 64 and rear guide rollers 66 which are supported to roll along the upper surfaces of the side rails 18 of the base frame 16. As better illustrated in FIG. 1, upper side rail members 68 are affixed in spaced relation to the lower side rails 18 a distance about the diameter of the guide rollers 66 and 68 to provide additional stability to the guide rollers 66 and 68 and prevent the seat 60 from being raised from the frame.

Figure 6:
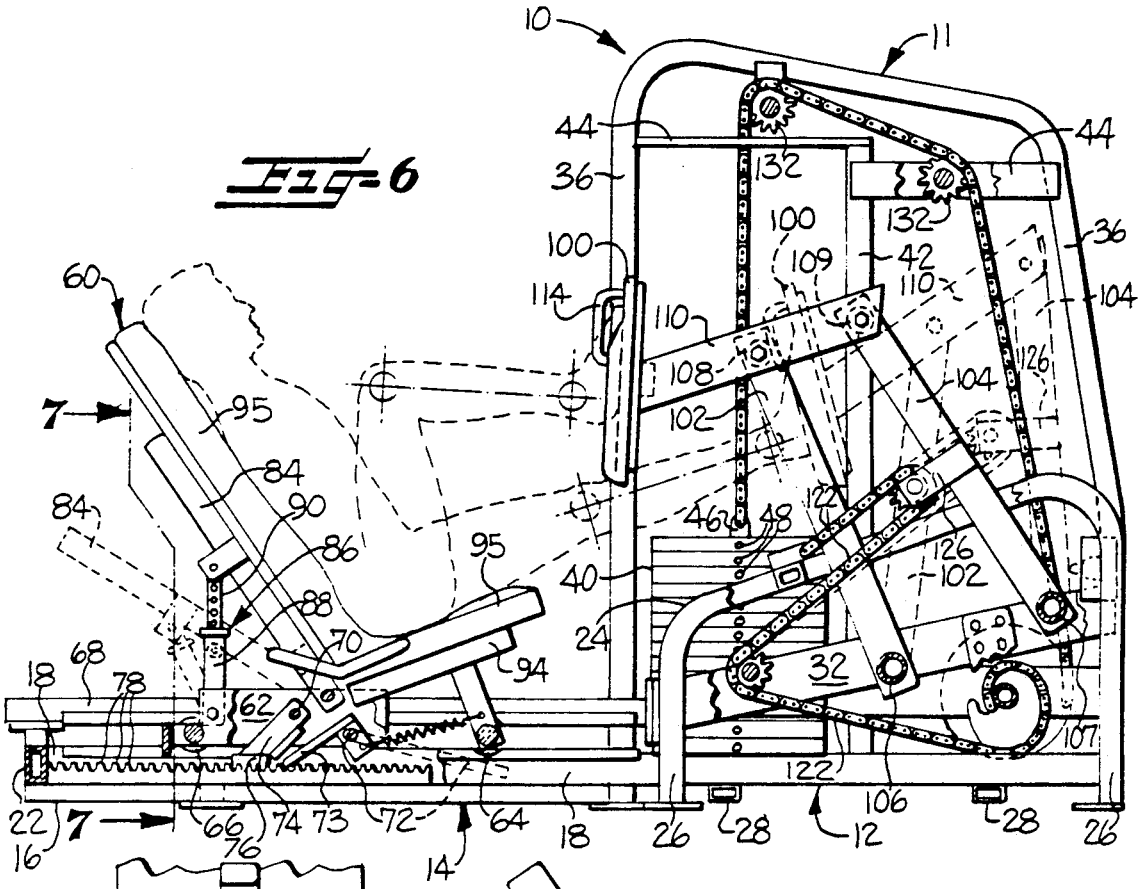
FIG. 6 is a somewhat schematic side elevational view of the exercise machine of FIG. 1 and showing the range of leg movement of a user and the corresponding movement of the first and second lever arms.
Figure 8:
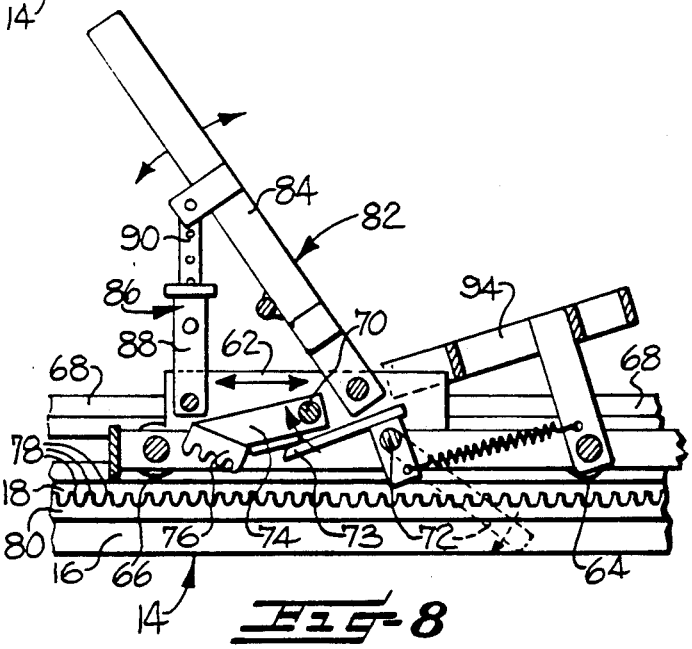
FIG. 8 is an enlarged fragmentary vertical sectional view of the seat of FIG. 6.

A pivot pin 70 extends through the guide roller support members 62 (FIG. 8) and has a lever bar 74 affixed thereto and rack teeth 76 for engaging teeth 78 positioned on a longitudinal support rack 80 fixed on the lower side rail 18 (FIGS. 6, and 8). A handle 72 extends through the guide roller support members 62 and has a lifting pawl 73 fixed thereto. The lifting pawl 73 is adapted to raise the lever bar 74 when the handle 72 is lowered. The guide roller support member 62 can be longitudinally adjusted in a position along the frame 11 by lifting the handle 72 to disengage the lever bar 74 rack teeth 76 from the teeth 78 of the longitudinal support rack 80 for allowing the guide roll support member to be rolled along the side frame rails 18. After the guide roll support member 62 has been longitudinally rolled to a desired position, the control handle 72 is raised to an intermediate position to move the rack teeth 76 of the lever bar 74 into engagement with the teeth 78 of the rack 80 and lock the seat 60 in a desired position. The seat 60 can be moved forwardly, one tooth 78 of the rack 80 at a time, by repeatedly raising the control handle 72 to the uppermost position.

Figure 7:
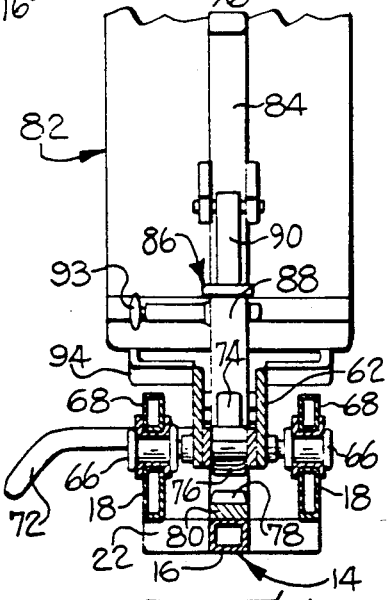
FIG. 7 is a vertical sectional view taken substantially along line 7—7 of FIG. 6.

A seat frame, indicated broadly at 82, is supported by the guide roll support members 62 and includes a back support rest member 84 pivotally mounted on its lower end to the guide roll support members 62 (FIG. 8). A two-piece, adjustable, and vertically extending back support brace, indicated broadly at 86, includes a lower outer sleeve 88 and an upper inner movable member 90 received in the sleeve. The lower outer sleeve 88 is pivotally mounted at its lower end to the guide roll support members 62 and the upper end of members 90 is pivotably mounted to a clevis member 92 fixed to the back support rest member 84. The back support brace 86 is adjustable in height by means of a selector pin 93 (FIG. 7) which can be removed out of guide holes for adjusting the extension distance of the upper inner member 90 relative to the lower outer sleeve member 88 and thus pivotally lowering and raising the same to a desired position for the back support rest member 84. An inclined buttock support frame member 94 is mounted on the guide roll support members 62. Padded cushions 95 are attached to the buttock support frame member 94 and the back support rest member 84.

A foot engaging member 100, in the form of a rectangular footboard, is adapted for engaging the feet of a user and receiving force therefrom for isolating and exercising the leg muscles. The footboard 100 is mounted for movement on the frame by a four-bar linkage which creates an instantaneous (changing) axis of rotation, as is conventional with four-bar linkage mechanisms. The four-bar linkage includes vertically extending first and second spaced lever arms 102, 104 which are pivotally mounted on respective lever arm shafts 106, 107, fixed at opposite ends to the lever arm mount braces 32. Respective first and second support shafts 108, 109 extend through the upper ends of each lever 102 104. Each support shaft 108, 109 is substantially similar in length and has its ends pivotably supported in a pair of spaced, substantially parallel support arms 110. The shafts 108, 109 and are mounted so that the distance between the lower first ends of the lever arms 102, 104 is greater than the distance between the upper second ends of the lever arms 102, 104. When the parallel support arms 110 are pivotally moved in a back and forth movement along a predetermined path of travel, the arm movement defines an instantaneous (changing) axis of rotation. The footboard 100 is affixed to the rear ends of the parallel support arms 110, and includes on one side thereof a handle 114 for grasping by a user and a bossed ridge 116 to define positions for left and right feet.

Means operatively connects the second lever arm 104 to the weight stack 40 for transmitting pivotal back and forth movement of the footboard 100 to movement of the weight stack to thereby exercise the legs of the user. This connecting means includes a force transmittance shaft 118 rotatably mounted between the lever arm mount braces 32. A variable radius cam 120 is supported by the shaft 118 and rotatable therewith. A chain 122 is entrained about the variable radius cam 120 and has one end fixed to the variable radius cam 120 and the other end fixed to the reinforcing cross brace member 28. The chain 122 extends upward from the variable radius cam 120 and is entrained about another idler sprocket and shaft assembly 124 and extends upward around a clevis and sprocket assembly 126 affixed to the second lever arm 104.

Figure 2:
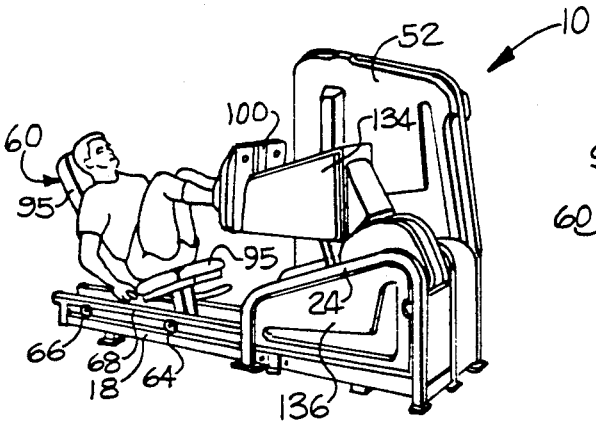
FIG. 2 is a perspective view of the leg exercise machine showing a seated user with legs in a retracted position before extending the legs in an exercise movement.
Figure 3:
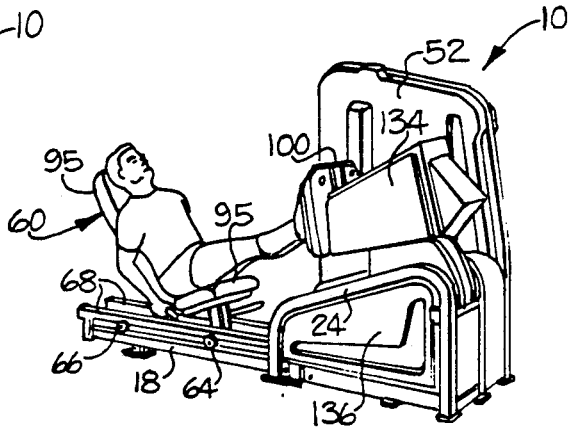
FIG. 3 is a view similar to FIG. 2 but showing the legs of the user extended in an exercise movement for pushing the footboard and lifting the weight stack.

As better illustrated in FIG. 5, a sprocket 128 is fixedly mounted on the shaft 118 supporting the variable radius cam 120 and rotatable therewith. A second chain 130 is affixed at one end to the sprocket 128 and extends upward along the inverted U-shaped weight support frame member 36 and is connected at its other end to the weight lifting rod 46 extending through the weight plates 40. The second chain 130 passes over a pair of idler sprockets 132 supported above the transverse cross bar 44 (FIG. 6). For protecting a user or bystander from injury resulting from moving parts, and for general aesthetic appearance, a two-piece cover 134 extends over the parallel support arms 110 (FIGS. 1-3) and another two-piece cover 136 also extends over and between the inverted U-shaped support braces 24.

METHOD OF OPERATION

In the use of the leg exercise machine, the user is positioned in the seat 60. The user initially adjusts the longitudinal position of the seat 60 on the side rails by lowering the handle 72 and moving the lever bar rack 76 out of engagement with the teeth of the support rack teeth 80. The user then moves and adjusts the seat and locks the seat in the desired position. The user selects the desired resistance by inserting the selector pin 50 into the desired opening 48 to engage the weight stack 40 with the weight lifting rod 46. The user places his feet on the footboard 100 and begins exercise by pushing against the footboard 100 and lifting the weight stack 40. During movement, the four-bar linkage mechanism, formed by first and second lever arms 102 and 104 keeps the forces directed axially up the tibia and lower leg substantially normal to the footboard 100 at all times. The instantaneous (changing) axis of rotation of the footboard 100 is varied by the four-bar linkage throughout the range of motion allowing the exercise machine to keep the forces properly directed as desired. The user repeats the cycle for as many repetitions as necessary during the exercise program.

The present invention offers several benefits over other prior art exercise machines. The four-bar linkage structure of the lever arms generates an instantaneous (changing or moving) axis of rotation of the footboard 100 so that the forces are directed axially up the lower leg and tibia at all times during an exercise movement. Thus, exercise efficiency is increased and the possibility of injury during the exercise movement is lessened because there is not a net force transverse to the muscle groups of the lower leg. Additionally, the seat can be adjusted longitudinally on the frame for varying the starting position of a user. This is especially beneficial for those users which are rehabilitating old injuries when the full range of exercise movement is not desirable.

In the drawings and specification there has been set forth the best mode presently contemplated for the practice of the present invention and although specific terms are employed, they are used in a descriptive sense only and not for purposes of limitation, the scope of the invention being defined in the claims.

That which is claimed is:

1. A leg exercise machine comprising a frame, a seat connected to said frame for supporting a user in a seated position thereon, a foot engaging platform adapted for engaging the bottom portions of the feet of a user and receiving force from the user legs, four bar linkage means pivotally mounted said foot engaging platform to said frame for allowing back and forth movement of said foot engaging platform along a predetermined path of travel about an instantaneously changing axis of rotation for changing the angle of inclination of said foot engaging platform and for directing a force substantially normal to said foot engaging platform substantially along the tibia and lower leg during corresponding movement of the user, resistance means, and means operatively connected said four bar linkage means to said resistance means for transmitting pivotal back and forth movement of said foot engaging platform to movement of said resistance means to thereby exercise the legs of a user.

2. A leg exercise machine according to claim 1 wherein said four bar linkage means includes first and second lever arms, means pivotally mounted a first end of each lever arm in spaced relation to each other on said frame, and means pivotally mounting the second ends of said lever arms in spaced relation to each other on said foot engaging platform.

3. A leg exercise machine according to claim 1 wherein said means operatively connecting said four bar linkage means to said resistance means includes a variable radius cam rotatably moveable with said foot engaging platform during back and forth movement thereof, said variable radius cam being operatively connected to said resistance means for varying the amount of force required to be exerted by a user on said foot engaging platform in accordance with the position of said foot engaging platform along said path of travel.

4. A leg exercise machine according to claim 3 including a shaft rotatably mounted on said frame, said variable radius cam being fixedly mounted thereto for rotatable movement with said shaft, a sprocket mounted on said shaft and rotatable therewith, and means interconnecting said sprocket and said resistance means.

5. A leg exercise machine according to claim 4 wherein said means interconnecting said sprocket and resistance means comprises a chain.

6. A leg exercise machine according to claim 1 wherein said seat includes means slidably mounting said seat on said frame for varying the distance of said seat from said foot engaging member for varying the range of starting positions of a user seated on said frame.

7. A leg exercise machine according to claim 2 wherein said four bar linkage means includes third lever arm means pivotally connecting said second ends of said lever arms.

8. A leg exercise machine according to claim 7 wherein said third lever arm means comprises a support shaft transversely mounted to the second end of each lever arm, and a pair of spaced substantially parallel support arms pivotally mounted on said shafts, said support arms being mounted and positioned on said shafts wherein the distance between said first ends of said lever arms mounted on said frame is greater than the distance between said second ends of said lever arms.

9. A leg exercise machine according to claim 1 wherein said resistance means comprises weight means supported for vertical movement on said frame to provide resistance through back and forth movement of said foot engaging member.

10. A leg exercise machine comprising a frame, a seat connected to said frame for supporting a user in a seated position thereon, first and second substantially vertically extending lever arms pivotably mounted at their lower ends on said frame in spaced relation to each other, a support shaft transversely mounted on the upper ends of each lever arm, a pair of spaced, substantially parallel support arms pivotally mounted on said shafts and being mounted so that the spaced distance between said lower lever arm ends is greater than the distance between the upper lever arm ends and wherein as said support arms are pivotally moved in a back and forth movement, said lever arm movement defines an instantaneous axis of rotation, a foot engaging member affixed to said parallel support arms for engaging the feet of a user and receiving force from the legs of the user and pivoting said first and second lever arms so as to move said foot engaging member in a back and forth movement along a predetermined path of travel about an instantaneous axis of rotation to thereby change the angle of inclination of said foot engaging member so that a force substantially normal to said foot engaging member is directed substantially along the lower leg and tibia during corresponding movement of the user, resistance means, and means operatively connecting said lever arms to said resistance means for transmitting the pivotal back and forth movement of said foot engaging member to said resistance means to thereby exercise the legs of a user.

11. A leg exercise machine according to claim 10 wherein said support shafts mounted on upper ends of first and second lever arms are substantially equal in length and have aligned opposing ends.

12. A leg exercise machine according to claim 10 wherein said means operatively connecting said second lever arm to said resistance means includes a variable radius cam rotatably moveable with said second lever arm during pivotable back and forth movement of said second lever arm, means operatively connecting said variable radius cam to said resistance means for varying the amount of force required to be exerted by a user on said foot engaging member in accordance with the position of said foot engaging member along said path of travel.

13. A leg exercise machine according to claim 12 including a chain entrained about said variable radius cam and having one chain end fixed to said cam and the other chain end fixed to said second lever arm.

14. A leg exercise machine according to claim 12 including a shaft rotatably mounted on said frame, said variable radius cam being fixedly mounted thereto for rotatable movement with said shaft, a sprocket fixedly mounted on said shaft and rotatable therewith, and means interconnecting said sprocket and resistance means.

15. A leg exercise machine according to claim 14 wherein said means interconnecting said sprocket and end resistance means comprises a chain.

16. A leg exercise machine according to claim 10 wherein said seat include means slidably mounting said seat on said frame for varying the distance of said seat from said foot engaging member for varying the range of starting positions of a user seated on said frame.

* * * * *

UNITED STATES PATENT AND TRADEMARK OFFICE

CERTIFICATE OF CORRECTION

PATENT NO. : 5,106,081

DATED : April 21, 1992

INVENTOR(S) : Gregory M. Webb

It is certified that error appears in the above-identified patent and that said Letters Patent is hereby corrected as shown below:

Column 1, line 24, after "movement" insert -- . --.

Column 3, line 50, change "now" to -- not --.

Column 4, line 65, after "102" insert -- , --.

Column 6, line 29, change "mounted" to -- mounting --.

Column 6, line 40, change "connected" to -- connecting --.

Column 6, line 47, change "mounted" to -- mounting --.

Signed and Sealed this

Seventh Day of September, 1993

Bruce Lehman

*Attest:*

BRUCE LEHMAN

*Attesting Officer*

*Commissioner of Patents and Trademarks*